US010087649B2

(12) United States Patent
Jones

(10) Patent No.: US 10,087,649 B2
(45) Date of Patent: Oct. 2, 2018

(54) PORTABLE SHADING DEVICE FOR A POOL

(71) Applicant: Rick Jones, Brandon, MS (US)

(72) Inventor: Rick Jones, Brandon, MS (US)

( * ) Notice: Subject to any disclaimer, the term of this patent is extended or adjusted under 35 U.S.C. 154(b) by 113 days.

(21) Appl. No.: 15/015,292

(22) Filed: Feb. 4, 2016

(65) Prior Publication Data

US 2017/0226767 A1 Aug. 10, 2017

(51) Int. Cl.

| | |
|---|---|
| ***E04H 4/00*** | (2006.01) |
| ***E04H 15/20*** | (2006.01) |
| ***E04H 4/12*** | (2006.01) |
| ***B05B 17/08*** | (2006.01) |

(52) U.S. Cl.

CPC ..... *E04H 15/20* (2013.01); *B05B 17/085* (2013.01); *E04H 4/12* (2013.01)

(58) Field of Classification Search

CPC ..... E04H 4/14
USPC ..... 4/496; 482/55
See application file for complete search history.

(56) References Cited

U.S. PATENT DOCUMENTS 5,135,440 A * 8/1992 Smollar ..... A63G 31/007 472/128
5,233,705 A * 8/1993 Coleman ..... A47C 15/006 4/496
5,551,922 A * 9/1996 Katz ..... A63G 21/18 4/494
6,062,983 A * 5/2000 Butsook ..... A63G 21/18 4/488
6,322,454 B1 * 11/2001 Gordon ..... A63B 69/0048 472/134
6,406,377 B1 * 6/2002 Demko ..... A63G 21/18 472/116
6,591,433 B1 * 7/2003 Sager ..... A47K 3/285 239/279
7,309,302 B1 * 12/2007 Phillips ..... A63C 19/10 472/116
2006/0021125 A1 * 2/2006 Berenson ..... E04H 4/0025 4/498
2009/0029785 A1 * 1/2009 McKee ..... A63G 21/00 472/117
2013/0318703 A1 * 12/2013 Berenson ..... A63G 21/18 4/494

* cited by examiner

*Primary Examiner* — Lori Baker
(74) *Attorney, Agent, or Firm* — Jerry D Haynes; Haynes Legal Group

(57) ABSTRACT

A pool side shading device that includes: an inflatable object, where inflatable object is placed near a swimming pool; a platform, where the platform is an integral part of the inflatable object; a flow of water over the platform, where the flow of water descends into the pool; and a water source, where the water source provides water for the flow of water. The inflatable object may preferably configured as a rock formation. The water source may be a water hose or water from the swimming pool through a pump. Further, the flow of water may be adapted to recirculate over the platform.

5 Claims, 1 Drawing Sheet

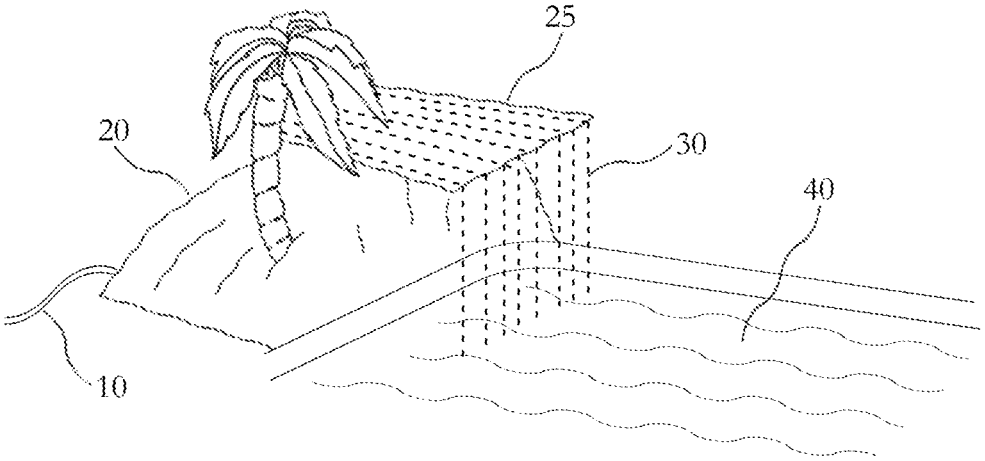
25
20
30
40
10

PORTABLE SHADING DEVICE FOR A POOL

BACKGROUND OF THE INVENTION

Field of Invention

The present invention relates to an inflatable, portable waterfall and shading device for a swimming pool.

Description of Related Art

Swimming pools are a common accessory to many homes. Swimming pools provide a great recreation activity for warm summer days and are especially enjoyable by many people. One aspect of the swimming pool is that the pool is usually used during sunny, warm days. As a result, using a pool results in skin exposure and possible skin damage in the form of sunburn or possible skin issues. Many individuals use umbrellas to provide shade or cover from the sun rays while enjoying a swimming pool. However, typically this involves getting out of the pool and sitting under the umbrella or other shading to provide cover from the sun. For the most part swimmers do not have many options to provide shading over or near the pool while enjoying a swim or recreation in the pool.

SUMMARY OF THE INVENTION

The present invention relates to a pool side shading device that includes: an inflatable object, where inflatable object is placed near a swimming pool; a platform, where the platform is an integral part of the inflatable object; a flow of water over the platform, where the flow of water descends into the pool; and a water source, where the water source provides water for the flow of water. The inflatable object may preferably configured as a rock formation. The water source may be a water hose or water from the swimming pool through a pump. Further, the flow of water may be adapted to recirculate over the platform.

BRIEF DESCRIPTION OF DRAWINGS

FIG. 1 depicts an inflatable and portable shading device in accordance with the present invention.

DETAILED DESCRIPTION

The present invention relates to an inflatable shading device in the form of a waterfall. In the preferred embodiment, the inflatable device resembles a rock formation with an elevated waterfall. The rock formation along with waterfall provides a form of shade near the edge of a swimming pool. A standard water hose or a water pump that uses the existing pool water may be implemented to produce a flow of water over a platform to create a waterfall at the top of the inflated rock formation. The water preferably recirculates and provides an enhanced aesthetic environment along with shading for the pool.

In reference to FIG. 1, an inflatable shading device according to the present invention is depicted. This shading device includes an Inflatable Rock Formation 20 as shown in FIG. 1. The inflatable rock formation 20 may be configured in various styles and configurations. At the top of the Rock Formation 20 is a Top Platform 25, which provides a pathway for the waterfall. The top platform 25 receives a flow of water creating a Waterfall 30 as shown in FIG. 1. This Waterfall 30 falls directly into a Pool 40 as shown in FIG. 1. Once completely assembled a Water Hose 10 may be connected to the inflatable rock formation and provides a flow of water to the Top Platform 25, where the Top Platform 25 is integrated with the Inflatable Rock Formation creating one inflatable object. This Top Platform 25 as shown includes a flow of Water 30 and provides shading for individuals that may be in the Pool 40.

As a result the present invention provides a novel recreational device to be used in conjunction with a typical swimming pool. This feature helps to provide shading for the pool and therefore can increase the enjoyment of the pool for users. The instant invention has been shown and described in what it considers to be the most practical and preferred embodiments. It is recognized, however, that departures may be made there from within the scope of the invention and that obvious modifications will occur to a person skilled in the art.

What is claimed is:

1. A pool side shading device comprising:

a. a portable inflatable object;

b. a swimming pool, wherein the portable inflatable object is placed at an edge of a swimming pool and said portable inflatable object is sufficient height to provide shading over the swimming pool;

c. a top platform, where the top platform is an integral part of the inflatable object; and d. a water source, where the water source provides a water fall from the top platform into the swimming pool.

2. The pool side shading device according to claim 1, where the inflatable object is configured as a rock formation.

3. The pool side shading device according to claim 1, where the water source is a water hose.

4. The pool side shading device according to claim 1, where the water source is water from the swimming pool through a pump.

5. The pool side shading device according to claim 1, where the flow of water is adapted to recirculates over the platform.

* * * * *